US009205653B2

(12) United States Patent
Tamai et al.

(10) Patent No.: US 9,205,653 B2
(45) Date of Patent: Dec. 8, 2015

(54) NOZZLE PLATE, LIQUID EJECTION HEAD, AND INKJET RECORDING DEVICE

(71) Applicants: Tomohiro Tamai, Kanagawa (JP); Toshiroh Tokuno, Tokyo (JP)

(72) Inventors: Tomohiro Tamai, Kanagawa (JP); Toshiroh Tokuno, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/594,240

(22) Filed: Jan. 12, 2015

(65) Prior Publication Data

US 2015/0202869 A1 Jul. 23, 2015

(30) Foreign Application Priority Data

Jan. 23, 2014 (JP) ..... 2014-010542
Feb. 14, 2014 (JP) ..... 2014-026157

(51) Int. Cl.
*B41J 2/16* (2006.01)
*B41J 2/14* (2006.01)

(52) U.S. Cl.
CPC ..... *B41J 2/1433* (2013.01)

(58) Field of Classification Search
CPC ..... B41J 2/1631; B41J 2/1433; B41J 2/1623; B41J 2/162; B41J 2/1628
USPC ..... 347/47, 44, 45
See application file for complete search history.

(56) References Cited

U.S. PATENT DOCUMENTS

2008/0287019 A1* 11/2008 Casas-Sanchez et al. ..... 442/60
2010/0053269 A1 3/2010 Fujii et al.
2011/0081493 A1* 4/2011 Matsushita ..... 427/384
2012/0001981 A1* 1/2012 Ohshima et al. ..... 347/20

FOREIGN PATENT DOCUMENTS

JP 2003-277651 10/2003
JP 2006-082362 3/2006
JP 2006-082363 3/2006
JP 2007-261070 10/2007
JP 2010-076422 4/2010
JP 2011-189641 9/2011

* cited by examiner

*Primary Examiner* — Manish S Shah
*Assistant Examiner* — Yaovi Ameh
(74) *Attorney, Agent, or Firm* — Cooper & Dunham LLP

(57) ABSTRACT

An improved nozzle plate includes a nozzle substrate having nozzle holes through which droplets are ejected, and a layer containing a compound having a perfluoro polyether skeleton its molecule. The layer is formed on the nozzle substrate on the side on which the droplets are ejected. The surface of the nozzle plate has an X-ray Photoelectron Spectroscopy (XPS) spectrum ascribable to oxygen atom such that the ratio of the area of peak 1 to the area of peak 2 ranges from 0.35 to 0.45, where the peak 1 represents peaks observed between 534 eV and 540 eV and the peak 2 represents peaks observed between 528 eV and 534 eV among peaks between 528 eV to 540 eV.

5 Claims, 7 Drawing Sheets

FIG. 2

| | |
|---|---|
| UPSTREAM PROCESS | POLISHING OF SURFACE OF NOZZLE SUBSTRATE |
| PRE-PROCESSING | ULTRASONIC WAVE WASHING OF SURFACE OF NOZZLE SUBSTRATE |
| LAYER FORMATION OF INK REPELLENT LAYER | ADJUSTMENT OF DIPPING LIQUID FOR FORMING INK REPELLENT LAYER |
| | PLASMA TREATMENT OF SURFACE (EJECTION SURFACE) OF NOZZLE SUBSTRATE |
| | DIPPED IN DIPPING LIQUID FOR FORMING INK REPELLENT LAYER |
| | LEFT AT ROOM TEMPERATURE |
| | HEATING |
| | ULTRASONIC WAVE WASHING |
| POST-PROCESSING | LAMINATE SURFACE OF INK REPELLENT LAYER FOR PROTECTION |
| | PLASMA TREATMENT OF SURFACE OF NOZZLE SUBSTRATE |
| DOWNSTREAM PROCESS | ATTACHMENT WITH LIQUID CHAMBER FORMING MEMBER |
| | HEATING AFTER ATTACHMENT |

FIG. 3

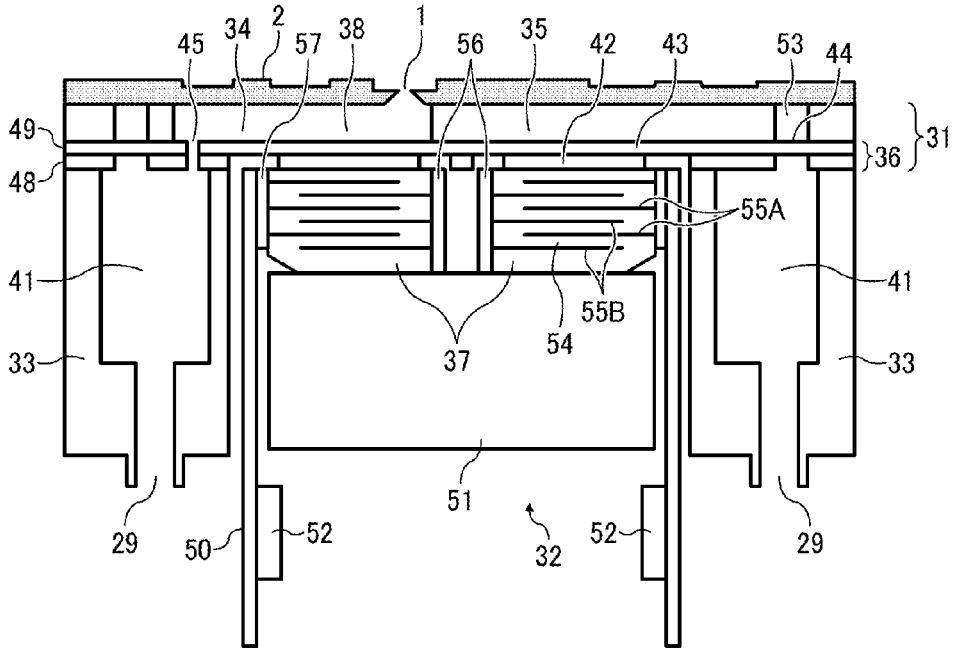

NOZZLE PLATE, LIQUID EJECTION HEAD, AND INKJET RECORDING DEVICE

CROSS-REFERENCE TO RELATED APPLICATIONS

This patent application is based on and claims priority pursuant to 35 U.S.C. §119(a) to Japanese Patent Application Nos. 2014-010542 and 2014-026157, filed on Jan. 23, 2014 and Feb. 14, 2014, respectively, in the Japan Patent Office, the entire disclosures of which are hereby incorporated by reference herein.

BACKGROUND

1. Technical Field

The present invention relates to a nozzle plate, a liquid ejection head, and an inkjet recording device.

2. Background Art

Ink having a high permeability is often used to improve the resolution of images in inkjet recording methods. However, ink having a high permeability has extremely high wettability since its surface tension is low, which invites a problem that the nozzle surface of an inkjet head (liquid ejection head) is easily contaminated.

Therefore, an inkjet head or a nozzle plate is demanded which is capable of suppressing contamination of the nozzle surface of the inkjet head and ameliorating the durability and water repellency of a water repellent layer on the liquid ejection surface of the substrate of the nozzle.

SUMMARY

The present invention provides an improved nozzle plate which includes a nozzle substrate having nozzle holes through which droplets are ejected, and a layer containing a compound having a perfluoro polyether skeleton its molecule. The layer is formed on the nozzle substrate on the side on which the droplets are ejected. The surface of the nozzle plate has an X-ray Photoelectron Spectroscopy (XPS) spectrum ascribable to oxygen atom such that the ratio of the area of peak 1 to the area of peak 2 ranges from 0.35 to 0.45, where the peak 1 represents peaks observed between 534 eV and 540 eV and the peak 2 represents peaks observed between 528 eV and 534 eV among peaks between 528 eV to 540 eV.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 2 is a table of an example of the manufacturing processes of the nozzle plate according to an embodiment of the present invention;

FIG. 3 is a cross section illustrating an example of the liquid ejection head according to an embodiment of the present invention;

DETAILED DESCRIPTION

Figure 1A:
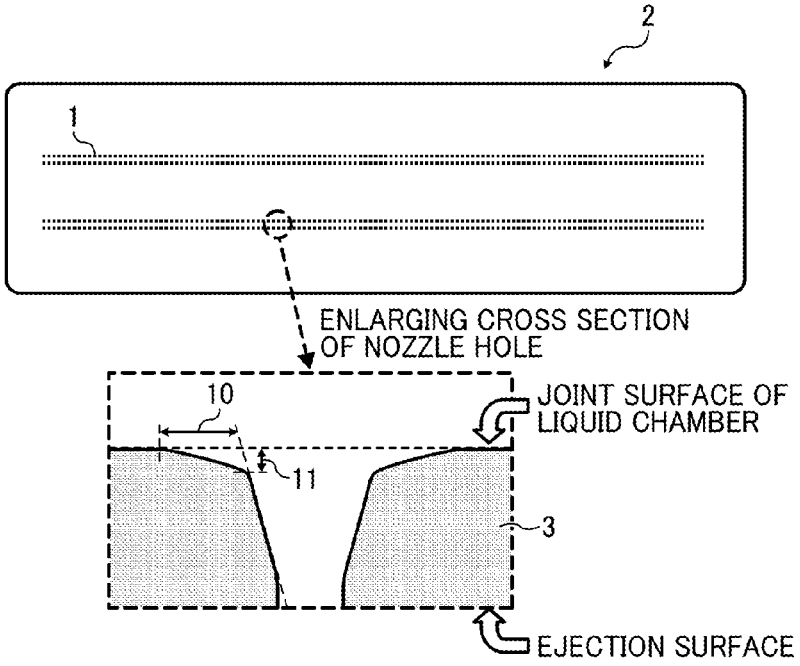
FIGS. 1A and 1B are a schematic diagram of an example of the nozzle plate according to an embodiment of the present invention and a schematic cross section thereof, respectively.

The present invention provides a nozzle plate that is highly durable and capable of removing remaining ink attached to the surface of the nozzle in a short period of time even when it is frictioned over a long period of time to remove the remaining ink.

The present disclosure is a nozzle plate including a nozzle substrate having nozzle holes through which droplets are ejected, and a layer containing a compound having a perfluoro polyether skeleton its molecule. The layer is formed on the nozzle substrate on the side on which the droplets are ejected. The surface of the nozzle plate has an X-ray Photoelectron Spectroscopy (XPS) spectrum ascribable to oxygen atom such that the ratio of the area of peak 1 to the area of peak 2 ranges from 0.35 to 0.45, where the peak 1 represents peaks observed between 534 eV and 540 eV and the peak 2 represents peaks observed between 528 eV and 534 eV among peaks between 528 eV to 540 eV.

The nozzle plate, the liquid ejection head, and the inkjet recording device of the present disclosure are described with reference to the accompanying drawings. Incidentally, it is to be noted that the following embodiments are not limiting the present disclosure and any deletion, addition, modification, change, etc. can be made within a scope in which man in the art can conceive including other embodiments, and any of which is included within the scope of the present disclosure as long as the effect and feature of the present disclosure are demonstrated.

Nozzle Plate

FIG. 1 is a schematic diagram illustrating an example of a nozzle plate 2 according to an embodiment of the present disclosure. As illustrated in FIG. 1A, the nozzle plate 2 has multiple nozzle holes 1. The inside form of the nozzle hole 1 has no particular limit but can be a horn-like form (substantially cylinder-like form or significantly circular truncated cone-like form). The size of the nozzle 1 is preferably a diameter of the ink droplet outlet of from 10 μm to 100 μm. In addition, the nozzle lines are spaced, for example, 150 dpi.

As illustrated in the enlarged cross section of the nozzle hole 1 of FIG. 1, the nozzle hole 1 can have a form having a corner drop width 10 and a corner drop height 11.

Incidentally, corner drop width×corner drop height/2 can be determined as the amount of drop, which is preferably small. Incidentally, an ink repellent layer 4 is omitted in FIG. 1A.

Figure 1B:
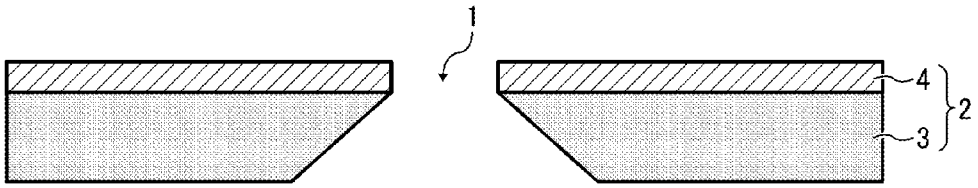

As illustrated in FIG. 1B, the nozzle plate 2 has a layer (hereinafter referred to as the ink repellent layer 4) which is formed of a compound containing a perfluoro polyether skeleton in its molecule and arranged on the surface of the droplet ejection of a nozzle substrate 3 on which the nozzle holes 1 are formed to eject droplets. As illustrated in FIG. 1B, the ink repellent layer 4 is formed on the ink ejection surface of the nozzle substrate 3.

The nozzle substrate 3 can be formed of stainless metal but is not limited thereto. The nozzle substrate 3 can be made of for example, Al, Bi, Cr. InSn, ITO, Nb, $Nb_2O_5$, NiCr, Si, $SiO_2$, Sn, $Ta_2O_5$, Ti, W, ZAO ($ZnO+Al_2O_3$), and Zn, and a layer can be formed thereon using these.

The ink repellent layer 4 is formed of a compound having a perfluoro polyether (hereinafter referred to as PFPE) skeleton in its molecule.

The perfluolo polyether can be any known product with no particular limit. Specific examples thereof include, but are not limited to, KrytoxFSL and KrytoxFSH (all manufactured by E. I. du Pont de Nemours and Company), FomblinZ™, FLUOROLINK®S10, and FLUOROLINK®C10 (all manufactured by Solvay Solexis), MORESCO phosfarol A20H, MORESCO phosfarol ADOH, and MORESCO phosfarol DDOH (all manufactured by MORESCO Corporation), Fluoro Surf® FG5010, Fluoro Surf® FG5020, Fluoro Surf®FG5060, and Fluoro Surf® FG5070 (all manufactured by Fluoro Technology).

The ink repellent layer 4 preferably has an average thickness of from 5 nm to 30 nm. When the ink repellent layer 4 has a thickness of 5 nm or greater, the surface is fully covered with the ink repellent layer, thereby preventing deficient hole on the layer to obtain suitable water repellency. When the ink repellent layer 4 has a thickness of 30 nm or less, falling off of partially thick portion as foreign objects by wiping can be avoided, which is suitable.

Manufacturing Process of Nozzle Plate

FIG. 2 is an example of the manufacturing processes of the nozzle plate according to an embodiment of the present invention. In FIG. 2, the upstream process, the pre-processing process, the layer formation process of ink repellent layer, the post-processing process, and the downstream process are illustrated. These are described with specific examples.

Incidentally, a stainless nozzle plate is described as an example of the nozzle substrate 3 but the nozzle substrate is not limited to the stainless nozzle plate.

Upstream Process

The upstream process is to polish the surface of the nozzle substrate 3, that is, the ejection surface from which an ink is ejected.

The surface on the side of ejection surface of a stainless nozzle plate on which the nozzle holes 1 are formed is polished by, for example, an ultra precision fluctuation type polishing machine (Chemical Mechanical Polishing (CMP) polisher, manufactured by Ebara Corporation) with POLIPLA103 (manufactured by Fujimi Incorporated) diluted with pure water at a volume ratio of POLIPLA103 to pure water of 1:3 when the stainless nozzle plate is rotated at 50 rotations per minute (rpm) while the surface of the stainless nozzle plate was being pressed by a polyurethane pad under a pressure of 10 kPa.

The surface roughness Ra of the ejection surface is preferably 0.1 μm or less.

One of the measuring methods of the surface roughness Ra of the ejection surface of the nozzle substrate 3 is as follows: The surface roughness Ra can be measured according to JIS 0601. For example, a stylus type surface shape measuring instrument (Dektak 150, manufactured by ULVAC Inc.) is suitable for measurement.

The surface roughness Ra can be adjusted by changing, for example, the pressure when pressing the surface of the plate with polyurethane pad, the rotation speed (rpm) when rotating the polyurethane pad, the flowing amount of polishing liquid, and the polishing time.

Pre-Processing Process

The pre-processing process is to treat the nozzle substrate 3 whose surface has been polished followed by ultrasonic wave washing. In addition to the ultrasonic wave washing, wet washing such as scrubbing washing, shower washing (high pressure spray washing, ultrasonic shower washing), dipping washing (flowing water washing, jet flowing washing, bubbling washing), and evaporation washing are possible.

The stainless nozzle plate after polishing is subject to ultrasonic wave washing by an organic solvent in a wet environment in order to prevent the polished surface from drying. As the wet environment, it is preferable to set the humidity 50% or higher for anti-dry.

As the organic solvent, alcohols such as acetone, ethanol, and isopropanol, and hydrofluoroethers such as Novec™ (manufactured by Sumitomo 3M), Vertrel® (manufactured by E. I. du Pont de Nemours and Company), and Galden® (manufactured by Solvay Solexis) can be used.

Layer-Formation Process of Ink Repellent Layer

The layer-forming process of the ink repellent layer 4 is as follows: First, a dipping liquid is prepared to form the ink repellent layer 4. The surface of the nozzle substrate 3 which has been treated with the pre-processing, that is, the ejection surface from which an ink is ejected is subject to plasma treatment. Other than the plasma treatment, it is possible to conduct dry washing such as vacuum washing (ion beam washing), normal pressure washing (UV ozone washing, ice scrubber washing, laser washing).

Thereafter, the prepared dipping liquid is applied to the nozzle substrate 3 according to a dipping method. After leaving at normal temperature (25° C.), the system is heated followed by ultrasonic wave washing to remove extra perfluoro polyether. It is preferable to adjust the layer thickness of perfluoropolyether to a single molecule layer level in the ink repellent layer 4.

As the dipping liquid of the ink repellent layer 4, it is possible to use what is prepared by diluting perfluoropolyether derivatives in a fluorine containing solvent to 1% by weight or less. It is preferable that the perfluoropolyether derivative has a polar group at its end. Specific examples of the polar group include, but are not limited to, —OH, C═O, —COOH, $—NH_2$, $—NO_2$, $—NH_3^+$, and —CN.

As the fluorine-containing solvent, Novec™ (manufactured by Sumitomo 3M), Vertrel® (manufactured by E. I. du Pont de Nemours and Company), and Galden® (manufactured by Solvay Solexis) can be used.

Furthermore, the ejection surface of the stainless nozzle plate is treated with oxygen plasma by, for example, plasma treating instrument (PDC-510, manufactured by YAMATO SCIENTIFIC CO., LTD.) at 500 W and 0.0012 g/s for one minute.

The layer of the ink repellent layer 4 is formed by, for example, dipping a stainless nozzle plate in a solvent, pulling it up at about 3 mm/s, and naturally drying it in a normal temperature environment for about ten minutes followed by heating at 100° C. for five hours for fixing. The heating temperature and the heating time can be changed to a particular application. The detail thereof is described later.

In addition, extra perfluoro polyether attached to the surface of the ejection surface of a stainless nozzle plate can be removed by ultrasonic wave washing, for example, for five minutes in the fluorine-containing solvent mentioned above.

Post Processing Process

The post processing process is as follows: To protect the surface of the ink repellent layer 4, the ejection surface is covered with laminate materials (laminate processing) and the reverse side of the nozzle substrate 3, that is, the opposite side of the ejection surface, is subject to plasma treatment.

With regard to the nozzle plate obtained as described above, its nozzle surface is protected by a plastic tape, which is irradiated with oxygen plasma (0.0012 g/s for one minute) by a plasma cleaner (PDC-510, manufactured by YAMATO SCIENTIFIC CO., LTD.) to remove the ink repellent layer attached to the inside wall of the nozzle hole and the liquid chamber surface by reverse sputtering.

As the tape, for example, it is preferable to use, for example, ICROS™ (manufactured by Mitsui Chemicals Tohcello Inc.) as high clean attachment plastic tape for semiconductor.

Incidentally, as a result of an investigation made by the present inventor, it was found that perfluoro polyether (PFPE) is oily with high fluidity at room temperature and the mobility of a liquid repellent layer formed on a nozzle plate was extremely high. Therefore, it was also found that, depending on the elapsed time after a liquid repellent layer on the liquid chamber joint surface opposite to the droplet ejection surface of a nozzle plate is removed by plasma treatment, a liquid repellent layer is formed again on the joint surface. The durability of a liquid ejection head jointed with a flow path plate constituting the liquid chamber in such a state becomes inferior, so that it is possible to significantly improve the durability of the liquid ejection head by conducting the joint (attachment) process within a particular time after the plasma treatment.

In the present disclosure, in a state in which the liquid repellent layer is removed from the liquid chamber joint surface by plasma treatment, it is preferable that the elapsed time, which is until PFPE serving as the repellent material is moved to the liquid chamber joint surface through nozzle holes, that is, from when the removal of the liquid repellent layer is complete till when the joint process starts, is one day at most. Consequently, since the liquid chamber joint surface of the nozzle plate is attached to the flow path plate forming the liquid chamber with no liquid repellent layer present on the joint surface, the liquid chamber joint surface of the nozzle plate and the flowing path plate forming the liquid chamber are firmly jointed.

Downstream Process

The downstream process is optional in which the nozzle substrate 3 and members, etc. constituting the liquid chamber are firmly attached by heating.

The nozzle plate obtained in the post-processing process is attached to the flow path plate using a low temperature curing type epoxy-based adhesive in the attachment process in the downstream process. It is preferable to conduct heating and pressure bonding to maintain the attachment state for an extended period of time. The heating temperature is preferably 80° C. of lower to avoid fatigue of members caused by heat. The heating and pressure bonding time is preferably from two hours to four hours in terms of productivity.

A specific example of the adhesive used is a low-temperature curing type epoxy-based adhesive. A preferable product as room-temperature curing type available on market is Scotch-Weld™ two liquid epoxy normal-temperature curing type adhesive (DP-460 EG, manufactured by Sumitomo 3M). As an adhesive which is not cured at room temperature but starts being cured at 60° C. to 100° C., for example, AE 901 series (manufactured by Ajinomoto Fine-Techno Co., Inc.) are specified.

X-Ray Photoelectron Spectroscopy (XPS) Measuring

In the present disclosure, the peak area ratio satisfies some conditions when the surface of a layer formed of a compound containing a perfluoro polyether skeleton in its molecule is measured by X-ray Photoelectron Spectroscopy (XPS).

XPS measuring is known as an analysis method in which the energy of photoelectron emitted upon irradiation of X-ray to a sample in ultra high vacuum environment is measured by an energy analyzer. Since the electron in the sample is bound by the nuclear at a certain level, the binding energy of a bound electron can be calculated from the irradiation X-ray energy and the kinetic energy of the photoelectron emitted upon irradiation of X-ray.

Since the binding energy of the bound electron is inherent to element, it is possible to obtain information related to the kind, the existing amount, the chemical bond state, etc. of the element by analyzing the energy spectrum of the photoelectron.

Figure 6:
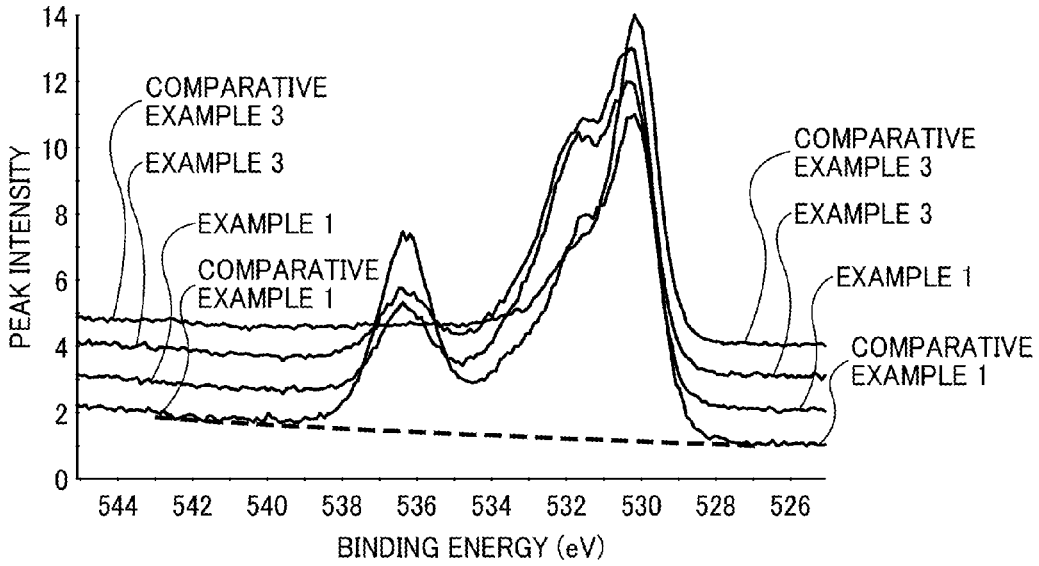
FIG. 6 is spectrum graphs illustrating an example of the results of X-ray Photoelectron Spectroscopy (XPS) measurement.
Figure 7:
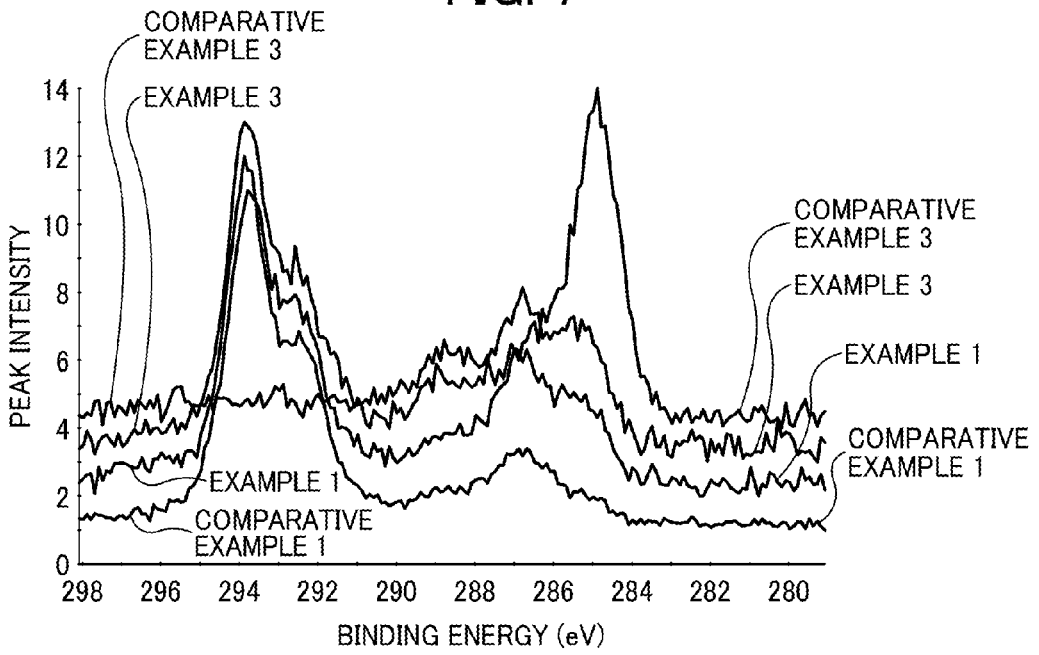
FIG. 7 is spectrum graphs illustrating another example of the results of X-ray Photoelectron Spectroscopy (XPS) measurement.

FIGS. 6 and 7 are graphs illustrating examples of spectra by XPS measuring. FIGS. 6 and 7 are graphs illustrating the results of XPS measuring about the surface of a nozzle plate on which perfluoro polyether is formed. In FIG. 6, the peaks seen between 528 eV and 540 eV are ascribable to oxygen atoms. The peaks ascribable to oxygen atoms are divided into those between 528 eV to 534 eV as peak 2 and those between 534 eV to 540 eV as peak 1.

In addition, in FIG. 7, the peaks seen between 282 eV and 296 eV are ascribable to carbon atoms. The peaks ascribable to carbon atoms are divided into those between 282 eV to 290 eV as peak 4 and those between 290 eV to 296 eV as peak 3.

Next, the method of obtaining the peak areas in the spectra obtained by the XPS measuring is described. In the present disclosure, the peak area in a spectrum obtained by XPS measuring is obtained by fully automatic X-ray electron spectrometer (K-alpha, manufactured by Thermo Fisher Scientific Inc.) Taking Comparative Example 1 of FIG. 6 as an example, the peak area is obtained by connecting the peak starting positions of 528 eV and 538 eV with a straight line (base line) as illustrated in a dotted line and calculating the area enclosed by the base line, peak 1, and peak 2 by integration. With regard to 282 eV to 296 eV, the peak area is obtained by determining a base line and integrating the area enclosed between the base line, peak 3, and peak 4.

In the present disclosure, the ratio of the peak 1 area to the peak 2 area ranges from 0.35 to 0.45. When the ratio is 0.35 or more, the nozzle surface is not contaminated by ink and the ink repellent time can be reduced. When the ratio is 0.45 or less, it is possible to avoid deterioration against wiping and contamination of the nozzle surface by ink.

In addition, in the present disclosure, the ratio of the peak 3 area to the peak 4 area preferably ranges from 2.5 to 3.5. When the ratio is 2.5 or greater, it is possible to avoid contamination of the nozzle surface by ink. When the ratio is 3.5 or less, contamination of the nozzle surface by ink and deterioration by wiping can be avoided.

There is no specific limit to the control of the peak area. For example, in the layer forming process of the ink repellent layer 4, it can be controlled by changing the heating temperature and the heating time after dipping in a dipping liquid for forming an ink repellent layer.

It is not possible to jump to any conclusion about a suitable range of the heating temperature because it depends on the solvent for use in layer forming of the ink repellent layer 4. Preferably, the heating temperature is from 80° C. to 250° C. and, more preferably, from 100° C. to 185° C. When the heating temperature is lower than 80° C., the solvent tends to remain in the ink repellent layer 4, which may degrade ink repellency. In addition, when the heating temperature is higher than 250° C., perfluoro polyether is dissembled, which leads to deterioration of ink repellency.

In addition, it is not possible to jump to any conclusion because the heating time can be changed depending on the solvent and the heating temperature for use in formation of the ink repellent layer 4. Preferably, it ranges from half an hour to one hour.

Liquid Ejection Head

The liquid ejection head using the nozzle plate of the present disclosure is described with reference to FIG. 3. In the liquid ejection head illustrated in FIG. 3, a flow path unit 31 and an actuator unit 32 are integratedly fixed via a frame 33. The flow path unit 31 includes laminates of the nozzle plate 2, a chamber plate 35, and a vibration plate 36 and ejects ink droplets by inflation and deflation of a pressure chamber 38 by expansion and contraction of individual piezoelectric oscillators 37 serving as pressure generating device of the actuator unit 32.

The nozzle hole 1 connecting the pressure chamber 38 is made on the nozzle plate 2 and the pressure chamber 38 and a fluid resistance 34 are formed in the chamber plate 35.

The vibration plate 36 is adjacent to a convex portion 42 contacting the tip of the piezoelectric oscillator 37, a diaphragm portion 43, and each pressure chamber 38. The piezoelectric oscillator 37 and the convex portion 42 face the diaphragm portion 43 and the pressure chamber 38. In addition, there is formed a liquid supplying mouth 45 to a common liquid chamber 41 provided to the frame 33. Moreover, a diaphragm portion 44, which is similar to the diaphragm portion 43, is formed on the area surfacing the common liquid chamber 41. The reference numeral 29 represents an ink supplying mouth to the head unit.

In the flow path unit 31, the chamber plate 35, the nozzle plate 2, and the vibration plate 36 are jointed. The chamber plate 35 can be made of, for example, stainless (SUS), but is not limited thereto. The vibration plate 36 is formed by laminating on an extended metal plate 48 a polymer film 49 formed of materials such as polyimide (PI) or polyphenylene sulfide (PPS) resin which are elastically flexible according to the fluctuation of the piezoelectric oscillators 37 and corrosion resistant to ink. Positioning holes having through-holes are formed at pivotal positions. The areas on which the diaphragm portions 43 and 44 are to be formed are subject to etching to form the convex portion 42 by the extended metal plate 48.

The size of the nozzle 1 is preferable that the diameter of the ink droplet outlet is from 10 μm to 100 μm, corresponding to the pressure chamber 38. In addition, the ink repellent layer 4 is formed on the nozzle surface (the surface in the ejection direction, that is, ejection surface) to secure repellency to liquids.

Furthermore, the piezoelectric oscillator 37 serving as the pressure generating device is jointed on the exterior surface (opposite surface to the pressure chamber 38) corresponding to each pressure chamber 38. These vibration plate 36 and pressure oscillator 37 form a piezoelectric type actuator to deform the diaphragm 43 being the movable portion of the vibration plate 36.

In the liquid ejection head, the piezoelectric oscillators 37 is formed without separation by slit processing. In addition, an FPC cable to provide a drive waveform to each piezoelectric oscillator is connected to one end surface of the piezoelectric oscillator 37.

Incidentally, it is possible to have a configuration in which the liquid in the pressure chamber 38 is pressurized using the fluctuation along the ink discharging direction and another configuration in which the liquid in the pressure chamber can be pressurized using the fluctuation along the direction perpendicular to the ink discharging direction. In this embodiment, the configuration along the ink discharging direction is used.

A base member 51 is preferably formed of metal materials. When the material of the base member 51 is a metal, it is possible to prevent heat accumulation ascribable to self heat generation of the piezoelectric oscillators 37. The piezoelectric oscillators 37 and the base member 51 are jointed by an adhesive. As the number of the channels increases, the temperature rises close to 100° C. by self heat generation of the piezoelectric oscillators 37, thereby weakening the adhesion strength significantly. In addition, the temperature inside the head rises due to self heat generation so that the liquid temperature rises. However, if the temperature of the liquid rises, the viscosity of the liquid deteriorates, which has an adverse impact on jetting properties. Therefore, by preventing self heat accumulation of the piezoelectric oscillators 37 by forming the base member 51 of metal materials, it is possible to prevent deterioration of jetting properties due to deterioration of adhesion strength and liquid viscosity.

In addition, the FPC cable 50 has multiple driver ICs 52 to apply drive waveforms (electric signals) to drive each channel (corresponding to each pressure chamber 38). Furthermore, the frame 33 is jointed around the vibration plate 36 with an adhesive. The common liquid chamber 41 is formed to this frame 33 to supply liquid to the pressure chamber 38 from outside, provided on the other side of the driver ICs 52 with at least the base member 51 therebetween.

This common liquid chamber 41 is communicated with the fluid resistance 34 and the pressure chamber 38 via the liquid supplying mouth 45 of the vibration plate 36.

A dumper chamber 53 is formed onto the common liquid chamber 41 by the diaphragm 44 to decay pressure waves generated in the common liquid chamber 41 by liquid ejection, thereby stabilizing the liquid ejection.

The piezoelectric oscillators 37 forms multiple piezoelectric oscillators by making slits by slit processing in a state in which a piezoelectric layer (piezoelectric material layer) 54, an internal electrode 55A and an internal electrode 55B are alternately laminated with both common side external electrode 56 and individual side external electrode 57 provided at both end surfaces.

In the liquid ejection head having such a structure, for example, by selectively applying a drive pulse voltage from 20 V to 50 V to the drive portion of the piezoelectric oscillator 37, the drive portion to which the pulse voltage is applied extends in the lamination direction to deform the diaphragm portion along the nozzle direction. The liquid in the liquid chamber 38 is pressurized by the volume change of the pressure chamber 38 to eject (jet) droplets through the nozzle hole 1.

Image Forming Apparatus

Figure 4:
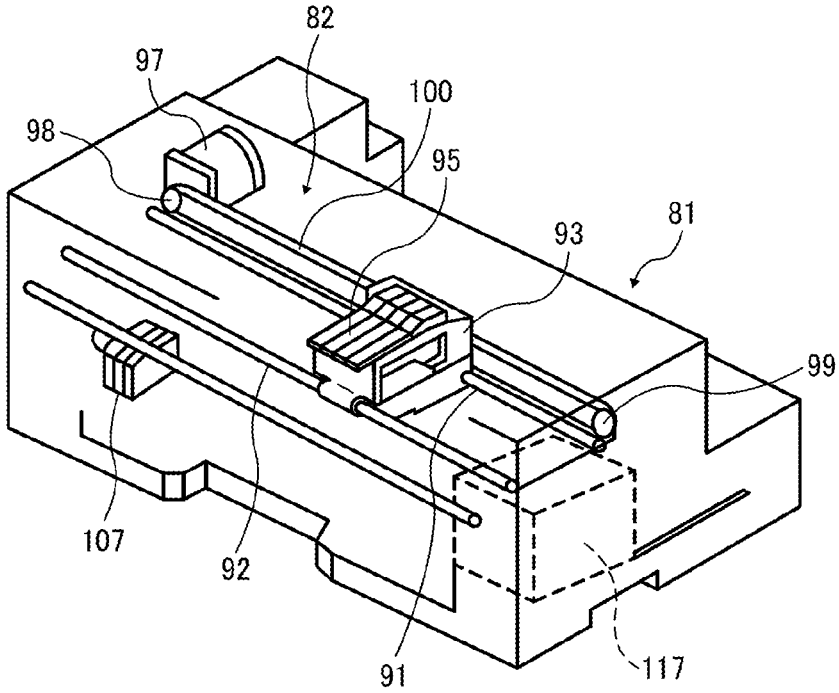
FIG. 4 is a diagram illustrating an example of the inkjet recording device according to an embodiment of the present disclosure.
Figure 5:
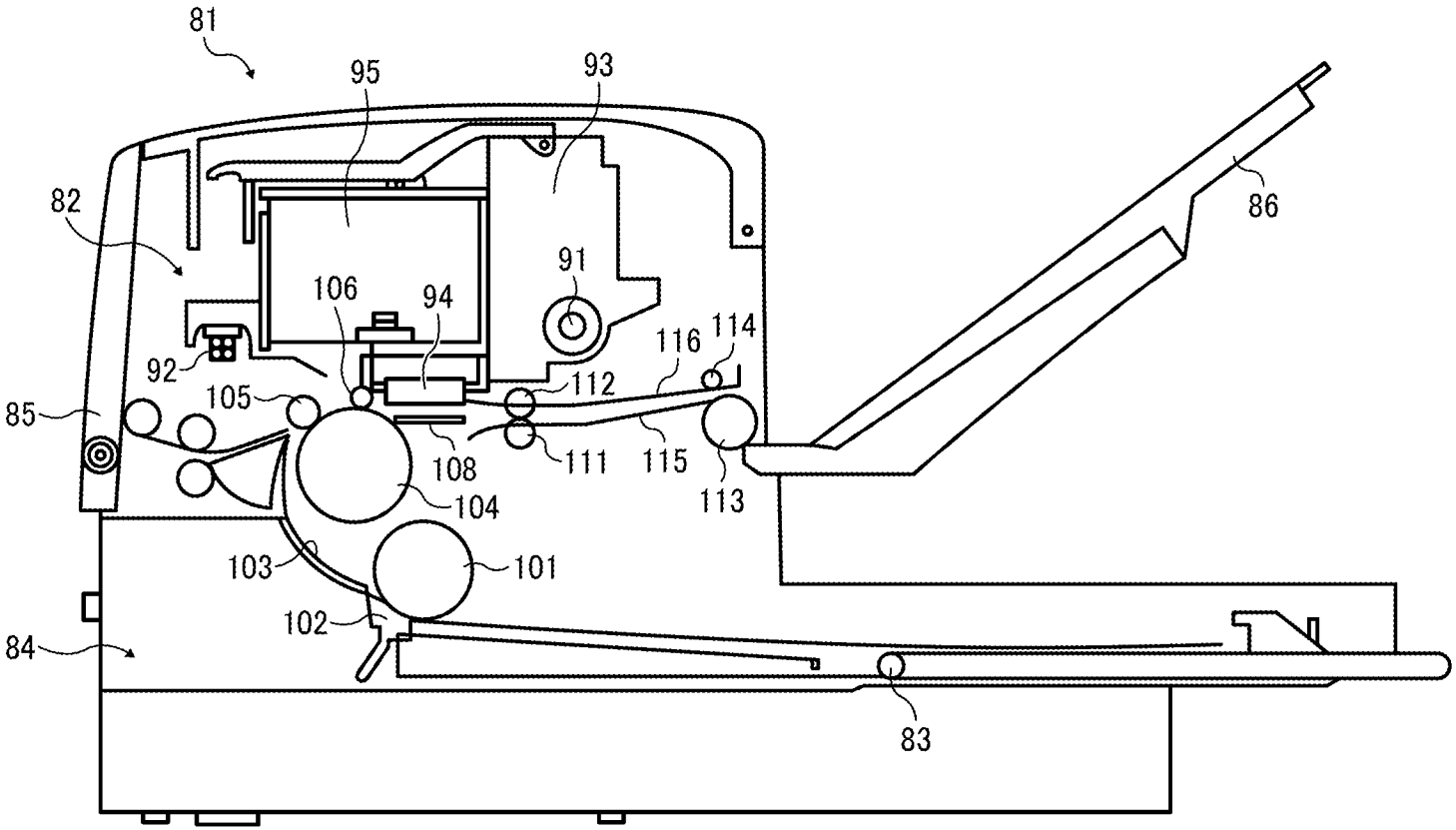
FIG. 5 is a cross section illustrating an example of the inkjet recording device according to an embodiment of the present disclosure.

Next, the image recording device having the liquid ejection head for use in the present disclosure is described using an example with reference to FIGS. 4 and 5.

Incidentally, FIG. 4 is a perspective view illustrating the image recording device and FIG. 5 is a side view illustrating the mechanism of the image recording device.

An image recording device 81 includes a carriage 93 movable in the main-scanning direction, a liquid ejection head formed of the image forming head of the present disclosure and installed on the cartridge 93, a printing mechanism portion 82 having an ink cartridge that supplies an ink to the liquid ejection head. A sheet feeding cassette (or tray) 84 that can load a number of sheets 83 from the front of the image recording device 81 is detachably attachable to the bottom thereof. In addition, a manual feed tray 85 to manually feed the sheet 83 is provided in an openable and closable manner. The sheet 83 fed from the sheet feeding cassette 84 or the manual feed tray 85 is taken in the image recording device 81. Thereafter, a desired image is printed on the sheet 83 by the printing mechanical portion 82 and the sheet 83 is discharged to a discharging tray 86 provided on the rear side of the image recording device 81.

The printing mechanism portion 82 holds the carriage 93 which can slidably move in the main-scanning direction (vertical direction to the surface of FIG. 5) by a main guiding rod 91 and a sub-guiding rod 92 serving as guiding members laterally bridged between side plates provided on the left side and the right side. This carriage 93 includes a liquid ejection head 94 formed of a liquid ejection head that ejects ink droplets of each color of yellow (Y), cyan (C), magenta (M), and black (Bk) with multiple ink ejection mouths (nozzles) arranged in the direction crossing the main-scanning direction, i.e., the ink droplet ejection direction downward. Each ink cartridge 95 to supply ink of each color to the liquid ejection head 94 is provided to the carriage 93 in a replaceable manner.

The ink cartridge 95 includes an air hole to communicate with air provided on the upper side of the ink cartridge 95, a supplying hole to supply an ink to the liquid ejection head provided on the bottom thereof, and porous solids filled with ink provided inside. The ink supplied to the liquid ejection head is maintained under a reduced pressure due to the capillary force of the porous solids. In addition, the liquid ejection head has the liquid ejection heads 94 of each color in this example but can be a single head having nozzles that eject ink droplets of each color.

The rear end (downstream from the sheet transfer direction) of the carriage 93 is fitted into the main guide rod 91 in a slidable manner and the front end (upstream from the sheet transfer direction) is set on the sub-guide rod 92 in a slidable manner. To move the carriage 93 for scanning in the main-scanning direction, a timing belt 100 is stretched between a driving pully 98 driven by a main scanning motor 99 and a driven pully 99 and fixed to the carriage 93 so that the carriage 93 is driven back and forth by proper and reverse rotation of the main scanning motor 97.

To transfer the sheet 83 set in the sheet feeding cassette 84 towards the bottom side of the liquid ejection head 94, there are provided a sheet feeding roller 101 and a friction pad 102 to separate and feed the sheet 83 from the sheet feeding cassette 84, a guiding member 103 to guide the sheet 83, a transfer roller 104 to reverse and transfer the fed sheet 83, a transfer roller 105 pressed against the circular surface of the transfer roller 104, and a front end roller 106 to regulate the sending angle of the sheet 83 sent from the transfer roller 104. The transfer roller 104 is rotationally driven by a sub-scanning motor 107 via gear train.

Moreover, there is provided a print receiving member 108 serving as a sheet guiding member situated below the recording head 94 to guide the sheet 83 sent from the transfer roller 104 corresponding to the moving range of the carriage 93 in the main-scanning direction. On the downstream of this print receiving member 108 from the sheet transfer direction, there are provided a transfer roller 111 and a spur 112 rotationally driven to send out the sheet 83 in the sheet ejection direction. Also there are provided a sheet ejection roller 113 and a spur 114 to send out the sheet 83 to the sheet ejection tray 86 and guiding members 115 and 116 to form a sheet ejection path.

By driving the liquid ejection head 94 according to image signals while moving the carriage 93, an ink is ejected to the sheet 83 not in motion to record an image of an amount corresponding to one line and thereafter the sheet 83 is transferred in a predetermined amount to conduct recording for the next line. On receiving a signal indicating that the recording has completed or the rear end of the sheet 83 has reached the image recording area, the recording operation stops and the sheet 83 is ejected.

In addition, a restoring device 117 is provided to restore discharging failure of the liquid ejection head 94 at the position out of the image recording area on the right end from the moving direction of the carriage 93. The restoring device 117 has a capping device, a drawing device, and a cleaning device. The carriage 93 is moved toward the restoring device 117 while waiting for printing and the liquid ejection head 94 is capped by the capping device to keep the nozzle portion in a wet state so that discharging failure caused by ink drying is prevented. Moreover, by jetting ink having nothing to do with recording in the middle of recording, the ink viscosity in the all the nozzles is kept the same to stabilize discharging performance.

When discharging failure occurs, the liquid ejection head 94 is sealed by the capping device, air bubbles, etc. is drawn from the nozzles via a tube together with ink by the drawing device, so that the ink and dirt attached to the nozzle surface is removed by the wiping device, resulting in restoring the nozzles from discharging failure. Moreover, the ink drawn is discharged to a waste ink storage provided on the bottom of the ink recording device 81 and absorbed and held in an ink absorbent arranged inside the waste ink storage.

Ink

Next, the ink for inkjet for use in the present disclosure is described.

The ink contains a coloring material, a wetting agent, a hydrosoluble organic solvent, a surfactant, other additives such as a pH regulator, an preservative and fungicide, a corrosion inhibitor, a hydrosoluble ultraviolet absorbent, a hydrosoluble infra red absorbent, and a resin.

Coloring Material

The coloring material can be any known pigment and dye. For example, inorganic pigments and organic pigments can be used.

As the inorganic pigments, titanium oxide, iron oxide, calcium oxide, barium sulfate, aluminum hydroxide, barium yellow, cadmium red, chrome yellow, and carbon black manufactured by known methods such as contact methods, furnace methods, and thermal methods can be used.

As the organic pigments, azo pigments (azo lakes, insoluble azo pigments, condensed azo pigments, chelate azo pigments, etc.), polycyclic pigments (phthalocyanine pigments, perylene pigments, perinone pigments, anthraquinone pigments, quinacridone pigments, dioxazine pigments, indigo pigments, thioindigo pigments, isoindolinone pigments, and quinofuranone pigments, etc.), dye chelates (basic dye type chelates, acid dye type chelates), nitro pigments, nitroso pigments, and aniline black can be used. Of these pigments, pigments having good affinity with solvents are preferable.

In addition to these, self-dispersible pigments can be used which has a functional group such as sulfone group and carboxyl group added to the surface of the pigment (e.g., carbon) to be dispersible in water. Also, it is possible to use a material in which a pigment is encapsulated in a microcapsule to be dispersible in water.

In addition, the addition amount of a pigment serving as coloring material in an ink preferably ranges from 0.5% by weight to 25% by weight and more preferably from 2% by weight to 15% by weight Hydrosoluble Organic Solvent Specific examples of the hydrosoluble organic solvent include, but are not limited to, polyols such as ethylene glycol, diethylene glycol, triethylene glycol, polyethylene glycol, polypropylene glycol, 1,5-pentane diol, 1,6-hexane diol, glycerin, 1,2,6-hexane triol, 1,2,4-butane triol, 1,2,3-butane triol, and petriol; polyol alkyl ethers such as ethylene glycol monoethyl ether, ethylene glycol monobutyl ether, diethylene glycol monometyl ether, diethylene glycol mono etyl ether, diethylene glycol monobutyl ether, tetraethylene glycol monomethyl ether, and propylene glycol monoethyl ether; polyol aryl ethers such as ethylene glycol monophenyl ether, and ethylene glycol monobenzyl ether; nitrogen-containing heterocyclic compounds such as N-methyl-2-pyrolidone, N-hydroxyethyl-2-pyrolidone, 1,3-dimethyl imidazolidinone, and ϵ-caprolactone; amides such as formamide, N-methylformamide, and N,N-dimethylformamide; amines such as monoethanol amine, diethanol amine, triethanol amine, monoethyl amine, diethyl amine, and triethyl amine; sulfur-containing compounds such as dimethyl sulfoxide, sulfolane, and thiodiethanol; propylene carbonate, γ-butyloractone, and ethylene carbonate.

Surfactant

Surfactants (surface active agent) are optionally added to improve washability, the mixing stability of washing liquid combined filling liquid, and refillability after washing. As the surfactants, for example, fluorine-containing surfactants, anionic surfactants, cationic surfactants, nonionic surfactants, and ampholytic surfactants can be suitably used.

Specific examples of the fluorine-containing surfactants include, but are not limited to, perfluoroalkyl sulfonic acid salts, perfluoroalkyl carboxylic acid salts, perfluoroalkyl phosphoric acid esters, adducts of perfluoroalkyl ethylene oxide, perfluoro alkyl betaine, perfluoro alkyl amine oxide compounds, polyoxyalkylene ether polymers having a perfluoro alkyl ether group at its side chain and sulfuric acid ester salts thereof, and fluorine-containing aliphatic polymer esters.

Specific examples of the products as fluorine-containing surfactants available on market include, but are not limited to, SURFLON S-111, SURFLON S-112, SURFLON S-121, SURFLON S-131, SURFLON S-132, SURFLON S-141, and SURFLON S-145 (all manufactured by ASAHI GLASS CO., LTD.); FLUORAD FC-93, FC-95, FC-98, FC-129, FC-135, FC-170C, FC-430, FC-431, and FC-4430 (all manufactured by SUMITOMO 3M); FT-110, FT-250, FT-251, and FT-400S (manufactured by NEOS COMPANY LIMITED); ZONYL FS-62, ZONYL FSA, ZONYL FSE, ZONYL FSJ, ZONYL FSP, ZONYL TBS, ZONYL UR, ZONYL FSO, ZONYL FSO-100, ZONYL FSN N, ZONYL FSN-100, ZONYL FS-300, and ZONYL FSK (all manufactured by E. I. du Pont de Nemours and Company); POLYFOX PF-136A, PF-156A, and PF-151N (manufactured by OMNOVA SOLUTIONS INC.).

Specific examples of the anion surfactant include, but are not limited to, alkyl allyl or alkyl naphthalene sulfonic acid salts, alkyl phosophoric acid salts, alkyl sulfuric acid salts, alkyl sulphonic acid salts, alkyl ether sulfuric acid salts, allkyl sulpho succinic acid salts, alkyl ester sulfuric acid salts, alkyl benzene sulfonic acid salts, alkyl diphenyl ether disulphonic acid salts, alkyl aryl ether phosphoric acid salts, alkyl aryl ether sulfuric acid salts, alkyl aryl ether ester sulfuric acid salts, olefin sulfonic acid salts, alkane olefin sulfocnic acid salts, polyoxyethylene alkyl ether phosphoric acid salts, polyoxyethylene alkyl ether sulfuric acid ester salts, ether carboxylate, sulfosuccinic acid salts, α-sulfoalicyclic acid esters, aliphatic acid salts, condensation products of a higher aliphatic acid and an amino acid, and naphthene acid salts.

Specific examples of the cationic surfactants include, but are not limited to, alkyl amine salts, dialkyl amine salts, aliphatic amine salts, benzalkonium salts, quaternary ammonium salts, alkyl pyridinium salts, imidazolinium salts, sulfonium salts, and phosphonium salts.

Specific examples of the nonionic surfactant include, but are not limited to, polyoxyethylene alkyl ether, polyoxyethylene alkyl allyl ether, polyoxyethylene alkylphenyl ether, polyoxyethylene glycol ester, polyoxyethylene fatty acid amide, polyoxyethylene fatty acid ester, polyoxyethylene polyoxypropylene glycol, glycerin ester, sorbitan ester, sucrose ester, polyoxyethylene ether of glycerin ester, polyoxyethylene ether of sorbitan ester, polyoxyethylene ether of sorbitol ester, fatty acid alkanol amide, amine oxide, polyoxyethylene alkyl amine, glycerin fatty acid ester, sorbitan fatty acid ester, polyoxyethylene sorbitan fatty acid ester, polyoxyethylene sorbitol fatty acid ester, and alkyl(poly)glycoxyde.

Specific examples of the amphoteric surfactants include, but are not limited to, imidazoline derivatives such as imidazolinium betaine, dimethyl alkyl lauryl betaine, alkyl glycine, and alkyl di(aminoethyhl) glycine.

Other Additives

Examples of other additives include, preservatives and fungicides, pH regulators, and preservatives and fungicides.

Specific examples the pH regulators include, but are not limited to, hydroxides of alkali metal elements such as lithium hydroxide, sodium hydroxide, and potassium hydroxide; carbonates of alkali metals such as lithium carbonate, sodium carbonate, and potassium carbonate; hydroxides of quaternary ammonium, amines such as diethanol amine and triethanol amine; ammonium hydroxide, and hydroxides of quaternary phosphonium. Specific examples of the preservatives and fungicides include, but are not limited to, 1,2-benzisothiazoline-3-on, sodium benzoate, dehydrosodium acetate, sodium sorbate, pentachlorophenol sodium, and 2-pyridine thiol-1-oxide sodium.

Binder Resin

Resins are optionally added to improve image fixability, the image quality, pigment dispersability, etc. Specific example of such resins include, but are not limited to, natural hydrophilic polymers such as vegetable polymers such as gum arabic, gum tragacanth, guar gum, karaya gum, locust bean gum, arabinogalactan, pectin, and quince seed starch; seaweed polymers such as alginic acid, carrageenan, and agar-agar; animal polymers such as gelatin, casein, albumin, and collagen; microorganism polymers such as xanthan gum and dextran; hydrophilic polymers obtained by modifying a natural product such as cellulose polymers such as methyl cellulose, ethyl cellulose, hydroxyethyl cellulose, hydroxypropyl cellulose, and carboxymethyl cellulose; starch polymers such as sodium starch glycolate and sodium starch phosphate; seaweed polymers such as sodium alginate and propylene glycol alginate; and hydrophilic synthetic polymers such as polyacrylic acid, polymethacrylic acid, copolymers of acrylic acid and acrylonitrile, copolymers of vinyl acetate and acrylic acid, copolymers of acrylic acid and acrylic acid alkyl ester, copolymers of styrene and acrylic acid, copolymers of styrene, acrylic acid, and acrylic acid alkylester, copolymers of styrene, methacrylic acid, and acrylic acid alkylester, copolymers of styrene, α-methyl styrene, and acrylic acid, copolymers of acrylic acid alkyl ester, copolymers of styrene and maleic acid, copolymers of vinyl naphthalene and maleic acid, copolymers of vinyl acetate and ethylene, copolymers of vinyl acetate and aliphatic acid vinyl ethylene, copolymers of vinyl acetate and maleic acid ester, copolymers of vinyl acetate and crotonic acid, and copolymers of vinyl acetate and acrylic acid.

The addition amount of these resins is determined considering the reliability thereof.

In addition, no resins which are soluble in a solvent but resin emulsions in which resins are finely-dispersed in a solvent have been used in most cases. In the resin emulsion, resin particulates are dispersed in a solvent as continuous phase. It can optionally contain a dispersant such as a surfactant.

The content (content of resin particulates in resin emulsion) of the resin particulates as the dispersion phase component is generally from about 10% by weight to about 70% by weight. As for the particle size of the resin particulate, its average particle diameter is preferably from 10 nm to 1,000 nm and more preferably from 20 nm to 300 nm considering the resin is used in an inkjet recording device.

Specific examples of the resin particulates as the dispersion phase component include, but are not limited to, acrylic resins, vinyl acetate-based resins, styrene-based resins, butadiene-based resins, styrene-butadiene-based resins, vinyl chloride-based resins, acrylic styrene-based resins, and acrylic silicone-based resins. Any known reliable resin emulsions available on market are usable. Of these, acrylic-silicone-based resins are particularly preferable.

The content of the resin particulates in an ink is generally from 0.1% by weight to 50% by weight, preferably from 0.5% by weight to 20% by weight, and more preferably from 1% by weight to 10% by weight.

Static Surface Tension

As the ink for use in the present disclosure, it is suitable to use an ink containing the fluorine-containing surfactant mentioned above and having a static surface tension of $30\times10^{-3}$ N/m or less. An ink having a static surface tension of $30\times10^{-3}$ N/m or less can be manufactured while adjusting the content of a permeating agent such as 2-ethyl-1,3-hexane diol and the addition amount of a fluorine-containing surfactant.

When the static surface tension is greater than $30\times10^{-3}$ N/m, the permeability of the ink to a recording medium easily becomes inferior, thereby degrading the image quality.

Surface tension can be obtained by, for example, Zisman method. According to this method, when a liquid whose surface tension is known is dripped on the ink repellent layer 4 and a contact angle $\theta$ is measured, a straight line with a minus slope is obtained by plotting the surface tension of the liquid on X axis and $\cos\theta$ on Y axis (which is referred to as Zisman Plot). Based on this straight line, the surface tension when $y=1$ ($\theta=0°$) is calculated as critical surface tension $\gamma c$.

In addition, the critical surface tension can be obtained by other methods such as Fowkes method, Owenes and Wendt method, and Van Oss method.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples and Comparative examples but not limited thereto.

Examples 1 to 3 and Comparative Examples 1 to 3

The surface of the ejection surface of a stainless nozzle plate on which nozzle holes having a diameter of 25 μm on the ink droplet outlet surface were formed was polished by, for example, an ultra precision fluctuation type polishing machine (Chemical Mechanical Polishing (CMP) polisher, manufactured by Ebara Corporation) with POLIPLA103 (manufactured by Fujimi Incorporated) diluted with pure water at a volume ratio of POLIPLA103 to pure water of 1:3 when the stainless nozzle plate was rotated at 50 rpm, while the surface of the stainless nozzle plate was being pressed by a polyurethane pad under a pressure of 10 kPa.

Thereafter, it was confirmed that the surface was polished to a degree that the surface roughness Ra was 0.1 μm or lower. The surface roughness Ra was measured according to JIS 0601 using a stylus type surface shape measuring instrument (Dektak 150, manufactured by ULVAC Inc.).

Next, the ejection surface of the stainless nozzle plate was treated with oxygen plasm by plasm treating instrument (PDC-510, manufactured by YAMATO SCIENTIFIC CO., LTD.) at 500 W and 0.0012 g/s for one minute.

Thereafter, as perfluoro polyether, Fluoro Surf® FG5020 (manufactured by Fluoro Technology) was diluted with a fluorine-containing solvent (Novec™ HFE-7100, manufactured by Sumitomo 3M) to 0.2% by weight, which was applied to the ejection surface of the stainless nozzle plate to form a layer thereon.

The layer was formed by dipping the plate in the solvent and pulling up the plate at 3 mm/sec. In the process of heating for fixing after the layer forming, as shown in Table 1, the heating temperature was changed between 25° C. and 300° C. and the heating time was also changed to form the ink repellent layer 4 of perfluoro polyether having different layer properties. The thickness of the ink repellent layer 4 was 12 nm. Furthermore, after the layer forming, the layer was subject to ultrasonic wave treatment for five minutes with Novec™ HFE-7100 (manufactured by Sumitomo 3M).

The nozzle surface of the thus-made nozzle plate was laminated for protection with ICRON™ TAPE (manufactured by Mitsui Chemicals Tohcello Inc.) and irradiated with oxygen plasma (0.0012 g/s for one minute) by a plasma cleaner (PDC-510, manufactured by YAMATO SCIENTIFIC CO., LTD.) to remove the ink repellent layer 4 attached to the liquid chamber surface and the inside wall of the nozzle holes 1 by reverse sputtering. Thereafter, the nozzle plate was heated and attached to a flow path plate under pressure at 70° C. for five hours via a low temperature-curing type epoxy-based adhesive.

The low temperature curing type adhesive used was AE601 series (manufactured by Ajinomoto Fine-Techno Co., Inc.), which is not cured at room temperature but starts to be cured at 60° C. to 100° C.

The nozzle plates of Examples 1 to 3 and Comparative Examples 1 to 3 were manufactured as described above.

XPS Measuring

The thus-obtained nozzle plates were subject to XPS measuring using a fully automatic X-ray electron spectrometer (K-alpha, manufactured by Thermo Fisher Scientific Inc.). The thus-obtained spectra are shown in FIGS. 6 and 7 (Examples 1 and 3 and Comparative Examples 1 and 3). Based on the spectrum obtained, the area enclosed by the base line, the peak 1, and the peak 2 was calculated to obtain the peak area ratio. Similarly, the area enclosed by the base line, the peak 3, and the peak 4 was calculated to obtain the peak area ratio. The base line is only illustrated for Comparative Example 6 of FIG. 6. The results are shown in Table 1.

Evaluation on Ink Repellent Time

Next, the ink repellent time was measured for the nozzle plates prepared in Examples 1 to 3 and Comparative Examples 1 to 3 in the following manner.

Figure 8:
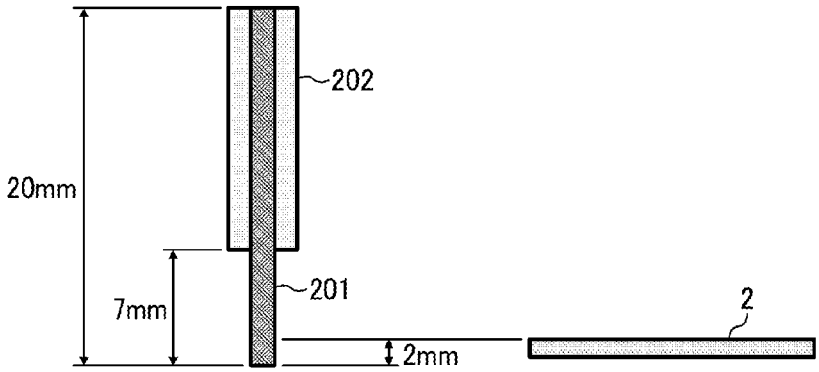
FIG. 8 is a schematic diagram illustrating an example of a wiper and a nozzle plate.

As illustrated in FIG. 8, one end of an ethylene propylene (EPDM) rubber blade (a wiper 201) having a thickness of 1.2 mm, a width of 30 mm, and a length of 20 mm was fixed at a rubber blade fixing jig 202 with 7 mm out of 20 mm flexible in the length direction.

Figure 9:
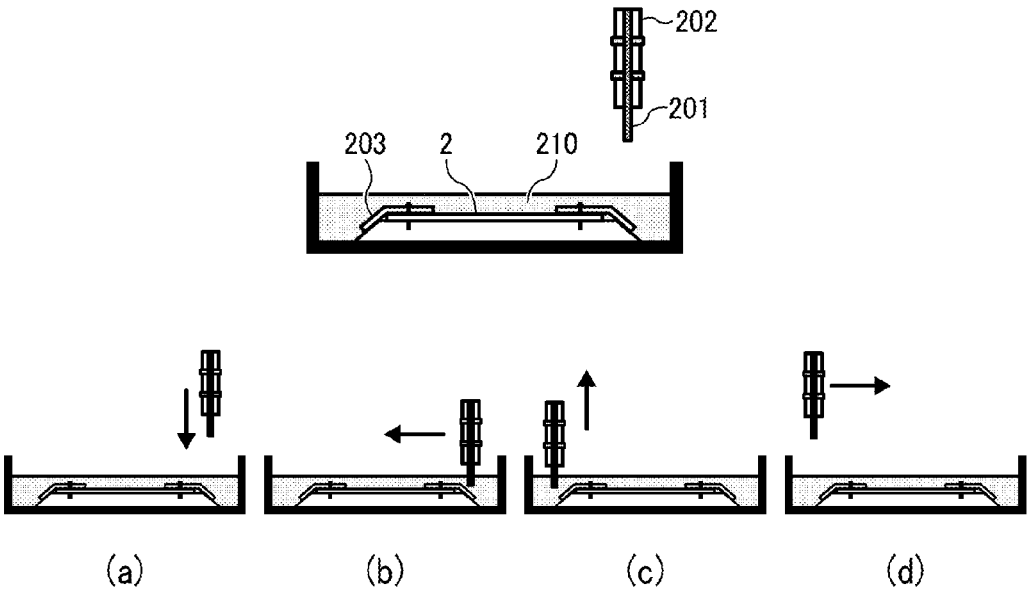
FIG. 9 is a schematic diagram illustrating an example of wiping.

Next, as illustrated in FIG. 9, the nozzle plate 2 was set in a container in which an ink 210 was placed so that the ejection surface of the nozzle plate 2 was dipped in the ink 210. As illustrated in FIG. 9(*a*) to (*d*), keeping this state, the ejection surface of the nozzle plate 2 was subject to one way wiping for 5,000 times at 100 mm/s while the rubber blade was being bent in a state in which the ejection surface was interfering with the nozzle plate 2 2 mm out of 7 mm.

"The state of being interfering with the nozzle plate 2 2 mm/7 mm)" means that, as illustrated in FIG. 8, if the flexible length is 7 mm of the rubber blade (the wiper 201), the length thereof that touches the nozzle plate 2 is 2 mm.

Figure 10:
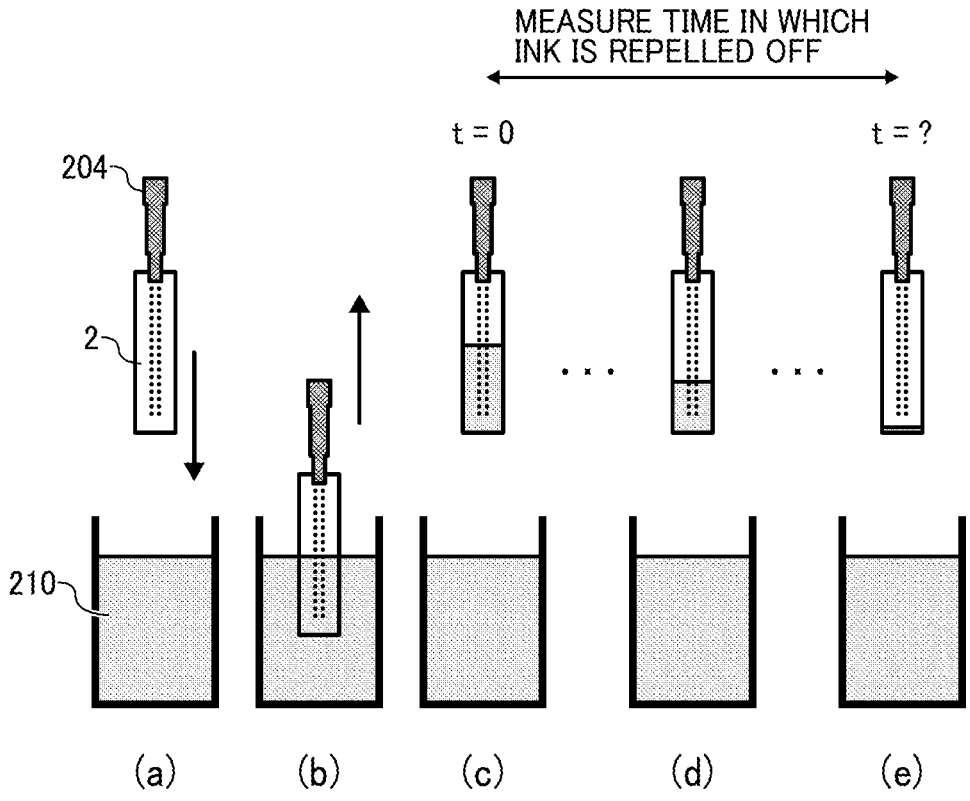
FIG. 10 is a schematic diagram illustrating an example of the measuring method of ink repellent time.

Next, the ink repellent time of the nozzle plate 2 after wiping was measured by the measuring method illustrated in FIG. 10. As illustrated in FIG. 10, a half of the tip (the nozzle plate 2) was dipped in the ink 210 (FIGS. 10(*a*) and (*b*)), pulled up at 100 mm/s, and immediately thereafter, the time between t=0 (FIG. 10(*c*)) and the time when the ink covered a tenth of the area at t=0 (FIG. 10(*e*)).

Ink

The ink used for measuring the ink repellent time was as follows: The composition of the following recipe was stirred and dissolved at 60° C. and left at room temperature. Thereafter, the solution was adjusted by 10% lithium hydroxide aqueous solution to have a pH of 9 to 10, which was filtered by Teflon™ filter of 0.22 μm to obtain [Ink 1]. [Ink 1] had a static surface tension of $30\times10^{-3}$ N/m.

| Prescription of Ink 1 | |
|---|---|
| C.I. Direct Black 168 | 3% by weight |
| 2-pyrroridone | 3% by weight |
| Diethylene glycol | 4% by weight |
| Glycerin | 1% by weight |
| Alkyl ether carboxylic acid salt-based surfactant (ECTD-3NEX, manufactured by NIHON SURFACTANT KOGYO K.K.) | 0.1% by weight |
| NONIPOL 400 (manufactured by Sanyo Chemical Industries, Ltd.) | 0.5% by weight |
| San-ai bac P-100 (manufactured by SAN-AI OIL CO., LTD.) | 0.4% by weight |
| Deionized water: | Rest |

The results of the ink repellent time of the nozzle plates obtained in Examples 1 to 3 and Comparative Examples 1 to 3 are shown in Table 1. In Table 1, "0 times" means the ink repellent time with no wiping and "5,000 times" means the ink repellent time after wiping 5,000 times. To function as the ink repellent layer 4, it is preferable that the ink repellent time is 50 seconds or less.

TABLE 1

| | Heating temperature and heating time at fixing after layer forming | | Peak ratio | | Ink repellency time (second) | |
|---|---|---|---|---|---|---|
| | Heating temperature (°) | Heating time (hour) | Peak ascribable to oxygen atom (peak 1/peak 2) | Peak ascribable to carbon atom (peak 1/peak 2) | 0 times | 5,000 times |
| Example 1 | 100 | 1.0 | 0.42 | 3.3 | 1 | 2 |
| Example 2 | 120 | 1.0 | 0.40 | 3.2 | 1 | 2 |
| Example 3 | 160 | 1.0 | 0.39 | 2.7 | 1 | 2 |
| Comparative Example 1 | 25 | 1.0 | 0.20 | 1.7 | 1 | 100 seconds or longer |
| Comparative Example 2 | 70 | 1.0 | 0.30 | 2.0 | 1 | 100 seconds or longer |
| Comparative Example 3 | 300 | 1.0 | 0.10 | 0.2 | 100 seconds or longer | 100 seconds or longer |

As seen in Table 1, it is found that as the form of the peaks ascribable to oxygen atom changes, ink repellency was not secured even before wiping in some cases (Comparative Example 3). Furthermore, while wiping was repeated, ink repellency deteriorated in Comparative Examples 1 and 2. Considering this, degradation of ink repellency can be determined by using the area ratio of peaks as measured by XPS.

Example 4

Liquid ejection heads having nozzle plates manufactured in Examples 1 to 3 and Comparative Examples 1 to 3 were manufactured.

Example 5

The liquid ejection heads obtained in Example 4 were installed in an inkjet printer (IPSIO GX e3300, manufactured by RICOH CO., LTD.) to obtain an inkjet recording device. [Ink 1] was well ejected by the inkjet recording device.

Example 6

The liquid ejection head of Example 6 was manufactured in the same manner as in Example 1 except that the elapsed time prior to starting joint (attachment) with the flow path plate was changed to one day.

Reference Example 1

The liquid ejection head of Reference Example 1 was manufactured in the same manner as in Example 1 except that the elapsed time prior to starting joint (attachment) with the flow path plate was changed to two days.

Evaluation Method and Results of Long Time Ink Ejection Property

Each of liquid ejection head manufactured in Examples 1 and 6 and Reference Example 1 was installed in a printer (RICOH GX-300, manufactured by RICOH CO., LTD.) and a test of long term continuous jetting test for 10,000 hours was conducted using ink for inkjet for RICOH GX-3000 (manufactured by RICOH CO., LTD.) to evaluate ink ejection property. The results are shown in Table 2.

TABLE 2

| | Example 1 | Example 6 | Reference Example 1 |
|---|---|---|---|
| Time elapsed between plasma treatment and start of joint | Immediately after | One day | Two days |
| Ink ejection property in long time continuous jetting test | Good | Good | Not good |

As seen in the results shown in Table 2, the liquid ejection heads of Examples 1 and 6 enjoyed good ink ejection property in the test of long term continuous jetting test for 10,000 hours but ink ejection by the liquid ejection head of Reference Example 1 was not good.

Thereafter, the liquid ejection head of Reference Example 1 was dissembled for problem cause determination of non-ejection of the head. It was found that the joint of the nozzle plate and the flow path plate forming the liquid chamber had been partially peeled off.

According to the present invention, a nozzle plate is provided that is highly durable and capable of removing remaining ink attached to the surface of the nozzle in a short period of time even when it is frictioned over a long period of time to remove the remaining ink.

Having now fully described embodiments of the present invention, it will be apparent to one of ordinary skill in the art that many changes and modifications can be made thereto without departing from the spirit and scope of embodiments of the invention as set forth herein.

What is claimed is:

1. A nozzle plate comprising:

a nozzle substrate comprising nozzle holes through which droplets are ejected; and a layer comprising a compound having a perfluoro polyether skeleton in a molecule of the compound, the layer being formed on the nozzle substrate on a side on which the droplets are ejected, wherein a surface of the layer comprising the compound having the perfluoro polyether skeleton in a molecule of the compound has an X-ray Photoelectron Spectroscopy (XPS) spectrum ascribable to oxygen atoms such that a ratio of an area of peak 1 to an area of peak 2 ranges from 0.35 to 0.45, where the peak 1 represents peaks observed between 534 eV and 540 eV and the peak 2 represents peaks observed between 528 eV and 534 eV among peaks between 528 eV to 540 eV.

2. The nozzle plate according to claim 1, wherein the surface of the layer comprising the compound having the perfluoro polyether skeleton in a molecule of the compound has an X-ray Photoelectron Spectroscopy (XPS) spectrum ascribable to carbon atoms such that a ratio of an area of peak 3 to an area of peak 4 ranges from 2.5 to 3.5, where the peak 3 represents peaks observed between 290 eV and 296 eV and the peak 4 represents peaks observed between 282 eV and 296 eV among peaks between 282 eV to 296 eV.

3. A liquid ejection head comprising:

the nozzle plate of claim 1.

4. An inkjet recording device comprising:

the ink ejection head of claim 3.

5. The inkjet recording device according to claim 4, accommodating an ink which comprises a fluorine-containing surfactant and has a static surface tension of $30\times10^{-3}$ N/m or less.

* * * * *